United States Patent [19]

LaCamera et al.

[11] 4,110,178

[45] Aug. 29, 1978

[54] FLOW CONTROL BAFFLES FOR MOLTEN SALT ELECTROLYSIS

[75] Inventors: Alfred F. LaCamera, Level Green; Thomas A. Trzeciak, Lower Burrell; Donald L. Kinosz, Tarentum, all of Pa.

[73] Assignee: Aluminum Company of America, Pittsburgh, Pa.

[21] Appl. No.: 797,746

[22] Filed: May 17, 1977

[51] Int. Cl.[2] ..... C25C 3/00; C25C 3/06

[52] U.S. Cl. ..... 204/64 R; 204/244; 204/67

[58] Field of Search ..... 204/64 R, 67, 68, 243, 204/247, 262, 244

[56] References Cited

U.S. PATENT DOCUMENTS

| | | | |
|---|---|---|---|
| 1,569,606 | 1/1926 | Ashcroft | 204/244 |
| 2,194,443 | 3/1940 | Hardy et al. | 204/247 |
| 3,374,163 | 3/1968 | Meier et al. | 204/64 R |
| 3,822,195 | 7/1974 | Dell et al. | 204/64 R |

*Primary Examiner*—John H. Mack
*Assistant Examiner*—H. A. Feeley
*Attorney, Agent, or Firm*—Elroy Strickland

[57] ABSTRACT

A method and apparatus for producing metal by electrolysis in a molten bath of salt. The apparatus includes an electrolytic cell containing a molten bath of salt and a vertical stack of electrodes located within the bath of salt, with the uppermost electrode being located beneath the upper level of the bath. A baffle extends vertically above the uppermost electrode, the baffle being effective to direct a flow of the bath laterally and beneath the upper level of the bath, and to increase the velocity of the flow of the bath and metal between vertically adjacent electrodes of the vertical stack.

4 Claims, 6 Drawing Figures

FLOW CONTROL BAFFLES FOR MOLTEN SALT ELECTROLYSIS

BACKGROUND OF THE INVENTION

The present invention relates generally to producing metal by electrolysis in a molten salt bath, and particularly to a technique for increasing the velocity of bath and metal flow while simultaneously preventing unwanted metal oxidation resulting from circulation of the molten salt into areas rich in an oxidizing agent.

For example, in cells containing molten salts of alkali metals or alkaline earth metals used in the production of aluminum by electrolysis of aluminum chloride dissolved in such salts, a vertical stack of spaced electrodes is ordinarily located within the bath of salt, such as shown in U.S. Pat. No. 3,822,195 issued in the name of Dell et al. In the electrolyzing process, chlorine gas is generated and rises to the upper portion of the cell and to an area above the upper level of the molten bath of salt, while molten metal is produced, which eventually settles to the lower portion of the cell, under force of gravity. This upward movement of chlorine gas causes circulation and an upward lift of the molten salt which, in turn, tends to carry a major amount of the produced molten metal with it. If the velocity of the upward flow is sufficiently high, the materials in the upward flow will break through the upper surface of the salt bath and enter into the area of the chlorine gas. Any metal that breaks through the upper surface of the bath and into the chlorine tends to recombine with the chlorine, the chlorine, in this case, being the oxidizing agent. The combined metal and chlorine then returns to the molten salt bath to again be decomposed in the electrolytic process. This results in reduced current efficiency of the cell since additional electrical current is required to act upon and reduce (again) the recombined metal and gas.

BRIEF SUMMARY OF THE INVENTION

The present invention solves this problem, while simultaneously enhancing cell operation in another manner presently to be explained, by using a vertically extending dam or baffle at a location above the uppermost electrode of the vertical stack, the baffle being effective to direct the upward flow of the bath laterally beneath the upper surface of the bath so that metal being carried upwardly by the bath will also be directed laterally beneath the upper surface of the bath and across the uppermost electrode. The lateral flow of the metal from the uppermost electrode then travels in a downward direction to the lowermost portion of the cell and thus away from the upper level of the bath and the location of the oxidizing gas.

In addition, it has been found that the dam or baffle increases the velocity of the flow of the bath between the electrodes such that the metal produced therein is more effectively swept from the electrodes, to thereby increase the operating efficiency of the cell, as explained in greater detail hereinafter.

BRIEF DESCRIPTION OF THE DRAWINGS

The invention, along with it objectives and advantages, will be best understood from consideration of the following detailed description in connection with the accompanying drawings in which.

DESCRIPTION OF PREFERRED EMBODIMENTS

Figure 1:
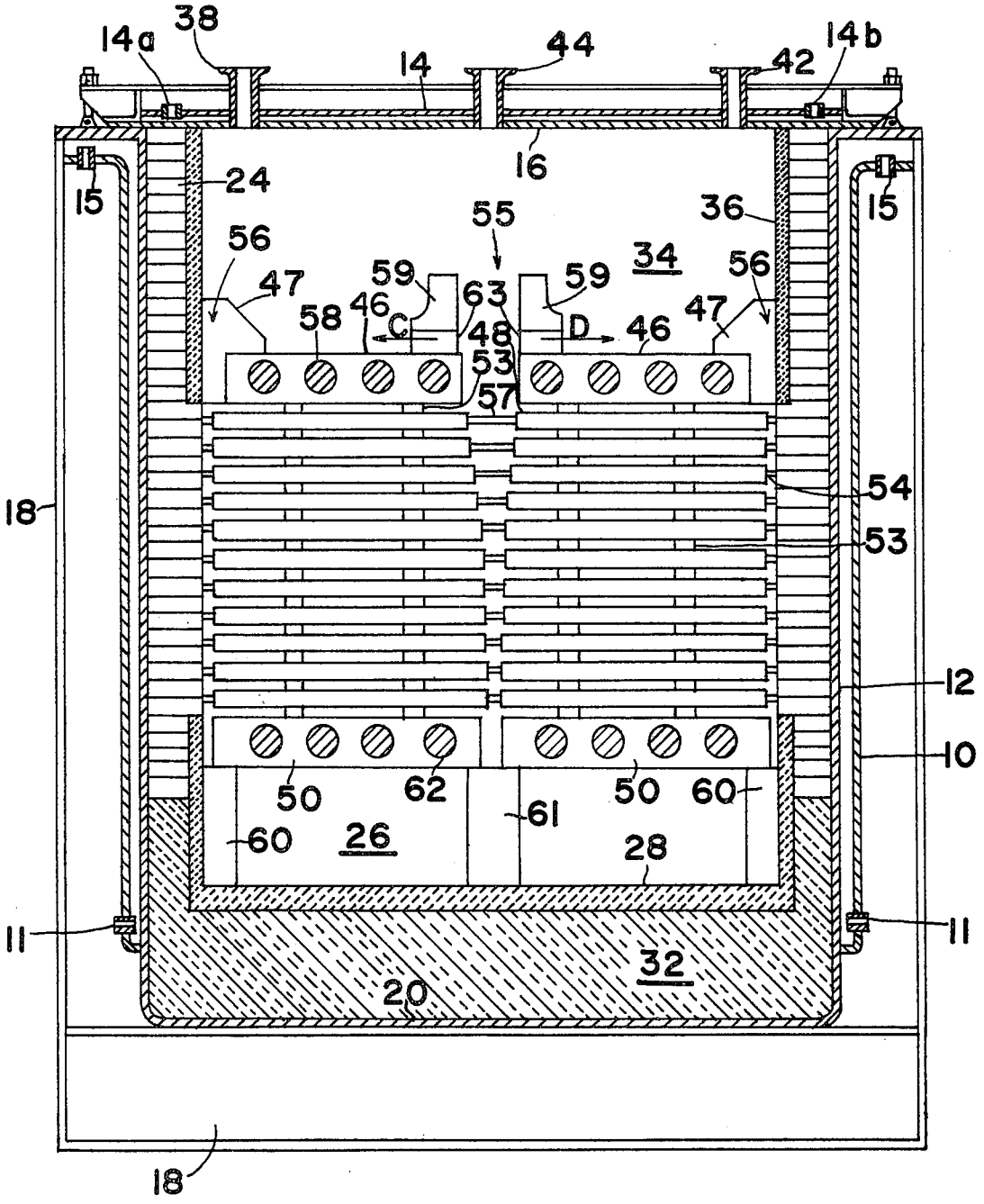
FIG. 1 is a sectional view of a cell for producing metal in accordance with the invention, with certain components (including two baffles 59) of the cell being shown in elevation.

Referring first to FIG. 1 of the drawings, a cell is shown for electrolytically producing aluminum by the electrolysis of aluminum chloride dissolved in a molten salt bath. The cell structure includes an outer cooling jacket 10, which surrounds the sides of the cell, the cell being enclosed in a steel shell 12. A cooling fluid or coolant, for example water, flows through jacket 10 for withdrawing heat from the cell during operation of the cell. The coolant enters the cooling jacket at inlet ports 11, and is removed at exit ports 15. A similar cooling jacket 14, with cooling inlet ports **14*a* and coolant outlet ports 14*b*, is located over a lid or cover 16 of the cell. 16** is exposed directly to chlorine and salt vapors and is made of a suitably chlorine-resistant metal such as the alloys nominally containing 80% Ni, 15% Cr and 5% Fe sold under the trademark Inconel.

A structural containment 18, for example of steel, is shown enclosing and supporting the cell and its cooling jacket 10.

The interior of metal shell 12, including a lower wall portion 20 of the shell, is preferably lined with a continuous, corrosion-resistant, electrically insulating, lining (not shown) of plastic or rubber material. Good results have been obtained with a lining composed of alternating layers of thermosetting epoxy-based paint and fiberglass cloth, as described in an application entitled "New Use of Materials in Molten Salt Electrolysis", filed concurrently herewith in the names of A. S. Russell and E. H. Rogers, Jr. Inwardly of the epoxy-fiber lining is preferably interposed a glass barrier of the type described in U.S. Pat. Nos. 3,773,643 and 3,779,699 issued in the names of Russell and Knapp.

The cell of FIG. 1 is also lined with refractory side wall brick 24, made of thermally insulating, electrically nonconductive, nitride material. Such a material is resistant to a molten aluminum chloride-containing halide bath and the decomposition products thereof, as disclosed in U.S. Pat. No. 3,785,941 to Jacobs. An additional lining 36 of graphite is positioned on the side walls alongside and above the anodes 46 of the cell to provide further protection against the corrosive influence of the bath and the chlorine gas produced by the operation of the cell.

The inside or cavity of the cell of FIG. 1 includes a sump 26 in the lower portion of the cell for collecting the aluminum metal produced in the cell. The sump comprises side or bottom walls made preferably from a graphite material 28. The graphite extends upwardly and beside cathodes 50 of the cell. The graphite 28 is located in and rests on a refractory floor 32 including the glass barrier mentioned above.

A bath reservoir area within the upper zone of the cell is indicated by numeral 34. The molten bath of the cell has been omitted in FIG. 1 for the purpose of better exposing the internal structure of the cell. The bath level in the cell will vary in operation but normally will lie above cell anodes 46 to fill all otherwise unoccupied space within the cell below the upper, liquid level surface of the bath.

A tapping port 38, extending through the lid 16 into reservoir 34, provides for insertion of a vacuum tapping tube (not shown) downwardly into sump 26 for removing molten aluminum. British Pat. No. 687,758 of H. Grothe, published Feb. 18, 1953, shows such a tube. A second, feeding port 42, provides inlet means for feeding aluminum chloride into the bath. A third port 44 provides means for venting chlorine from the cell. These ports are shown open and unoccupied in FIG. 1, as a matter of convenience. During cell operation, port 38 may have vacuum tapping apparatus associated with it while port 42 will have a feeder mechanism attached to it; port 44 may be connected to a pipeline for carrying away a chlorine-rich effluent. Other ports may be provided, for instance a return port for materials condensed out of the predominantly chlorine effluent leaving through port 44; in this connection, see U.S. Pat. No. 3,904,494 issued in the name of Jacobs et al. for "Effluent Gas Recycling and Recovery in Electrolytic Cells for Production of Aluminum from Aluminum Chloride". Additionally, ports may be provided for inspection, or bath sampling, and for use of instruments such as thermocouples or conductivity dip cells (See U.S. Pat. No. 3,996,509 issued in the name of Seger for "Conductivity Dip Cell".), the latter being useful in controlling, for example, the aluminum chloride content of the bath in accordance with U.S. Pat. No. 3,847,761 to Haupin for "Bath Control". All ports are made of the above-mentioned alloy sold under the trademark Inconel.

Within the cell cavity are a plurality of platelike electrodes 46, 48 and 50 disposed in two vertical stacks. In a direction perpendicular to the plane of FIG. 1, in which direction the depth of the electrodes lies, the electrodes extend to and abut against the lining of the cell. Each stack includes an upper anode 46, a plurality of bipolar electrodes 48 (11 being shown), and a lower cathode 50, all being made, for example, of graphite. These electrodes are arranged in superimposed, spaced relationship defining a series of interelectrode spaces 45 within the cell. Each electrode is preferably horizontally disposed within a vertical stack.

Each cathode 50 is shown supported by a plurality of lateral support pillars 60 and central support pillars 61, the pillars being spaced from each other in the direction of the depth of the electrodes, i.e., into the plane of the drawing paper. The remaining electrodes are stacked one above the other in a spaced relationship maintained by refractory spacers 53 (in the interelectrode spaces 45) and are connected to, and spaced from, the side walls by individual insulating pins 54. The spacers 53 are dimensioned to closely space the electrodes, as for example to space them with their opposed surfaces separated by less than $\frac{3}{4}$ inch.

Above the vertical stacks, hold-down blocks 47 bear on the upper surfaces of the anodes 46 to maintain the stacks in place.

In the illustrated embodiment of FIG. 1, twelve interelectrode spaces 45 are formed between opposed electrodes in each stack, one interelectrode space between cathode 50 and the lowest of the bipolar electrodes, 10 between successive pairs of intermediate bipolar electrodes, and one between the highest of the bipolar electrodes and anode 46. Each interelectrode space is bounded above by an electrode lower surface (which functions as an anodic surface) and below by an electrode upper surface (which functions as a cathodic surface), as discussed in detail in the above-mentioned U.S. Pat. No. 3,822,195.

Between the stacks of electrodes is located a gas lift passage 55, which passage is maintained by narrow, heat and corrosive resistant spacers 57 extending between the inward ends of the electrodes. The widths of the electrodes in the stacks are chosen to provide passage 55 with its greatest breadth between the anodes 46, the breadth decreasing in a downward direction, with the smallest breadth being between the lowest bipolar electrodes. Passage 55 provides for the upward circulation of the bath material to reservoir area 34 after passage thereof through the interelectrode spaces. In the electrolysis process, chlorine gas is produced in the interelectrode spaces, which then moves toward the ends of the electrodes. The surfaces of the electrodes are preferably provided with chlorine removing channels (not shown) that extend into the passage 55, such channels being blocked-off on their ends opposed to passage 55. It has been found that this aids in starting the chlorine in the right direction, i.e. toward, and into, passage 55, though such blocking is not indispensable. Once the chlorine starts flowing in the desired direction, and provided the cross sectional dimensions of the various flow passageways in the cell have been properly dimensioned, the flow of chlorine is maintained in the proper direction and the molten bath of salt is thereby circulated in a pattern that also directs the bath to passage 55. The gas flow can be started in the desired direction by other means, for example by using a mechanical pumping of the bath or by introducing a pulse of gas at the bottom of passage 55. The dimensioning of passage 55 and the remainder of the flow cross sections in any particular cell are advantageously carried out using water modeling techniques.

Between each electrode stack and refractory side walls 24 are two bath flow passages 56, each passage 56 being a series of aligned gaps between the cell walls and the outer electrode ends. The movement of bath in the passages 56 is downwardly past anodes 46, thus passing first into the outside regions of the uppermost interelectrode spaces where portions of the bath split-off to supply and sweep the uppermost interelectrode spaces. In reference to either of the two sides, the remainder of the bath then flows downwardly past the outside of the next electrode to the outside of the next interelectrode space, and so on. A final portion of the bath may flow on through the openings on the outside of the cathodes 50 into, through the sump 26, then up into passage 55. As indicated above, design of the dimensions of the various parts of the gas lift and bath supply passages can be carried out advantageously using the principles of water modeling to assure that the forming metal is swept out of each interelectrode space without substantial accumulation of the metal on the cathode surfaces.

The anodes 46 have a plurality of electrode bars 58 (shown in section) inserted therein which serve as positive current leads, while cathodes 50 have a plurality of collector bars 62 (shown in section) inserted therein which serve as negative current leads. The bars extend through the cell and cooling jacket walls and are suitably insulated therefrom in the manner, for example, of U.S. Pat. No. 3,745,106 to Jacobs.

Figure 2A:
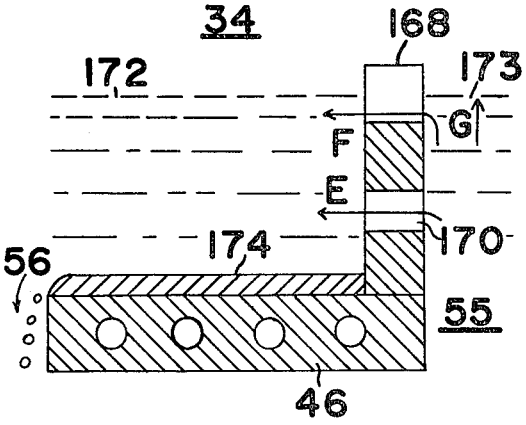
FIG. 2A is a sectional view of an alternative embodiment of the baffles shown in FIG. 1.
Figure 3A:
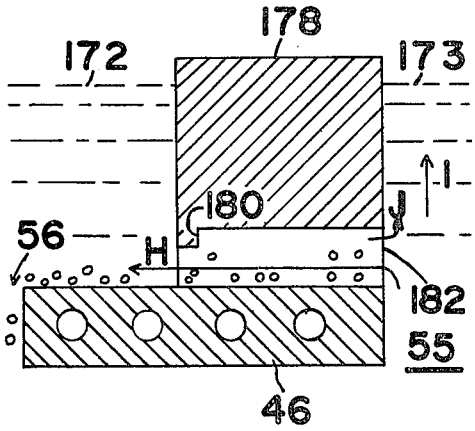
FIG. 3A is a second alternative embodiment of the baffles of FIG. 1.

Above anode 46 and adjacent the upper exit end of passage 55 are located two vertically extending upcomer baffles or dams 59, again made of a heat and corrosive resistant material. The upper ends of the dams protrude vertically to a location above the upper level of the bath (not shown in FIG. 1) and provide horizontally extending openings or passageways 63 that are effective to direct the lateral, sweeping flow of the bath above the anodes 46, as indicated by arrows C and D in FIG. 1, but below the upper surface of the bath. Passageways 63 open on both sides of each dam 59 below the surface of the bath, while the bath surface itself is below the upper edges of dams 59. (These relationships are best appreciated in FIGS. 2A and 3A, presently to be described.) The resulting flowpath resists the tendency of particles or globules of molten metal, which are brought upwards through the passage 55 by the upward flow of the bath, from breaking the bath surface and contacting the metal-oxidizing chlorine above the bath. Ideally, the metal produced on the cathodic surfaces of the cell falls in passages 55 and 56 to sump 26; however, because of the substantial upward flow of gaseous chlorine, metal is swept upwardly and is rechlorinated (by breaking through the upper surface of the bath) without the presence of appropriate baffles, such as 59. Rechlorination adversely affects current efficiency of the cell, i.e. the rechlorinated metal requires electrolytic reduction, this reduction requiring additional amounts of electrical current. It is to guard against such unnecessary reduction that dams or baffles are provided. The bath flow velocity over anodes 46 (in the directions of arrows C and D in FIG. 1) is great enough to perform the same sweeping action described in U.S. Pat. No. 3,822,195 in connection with the cathodic surfaces of the interelectrode spaces of U.S. Pat. No. 3,822,195.

Figure 2B:
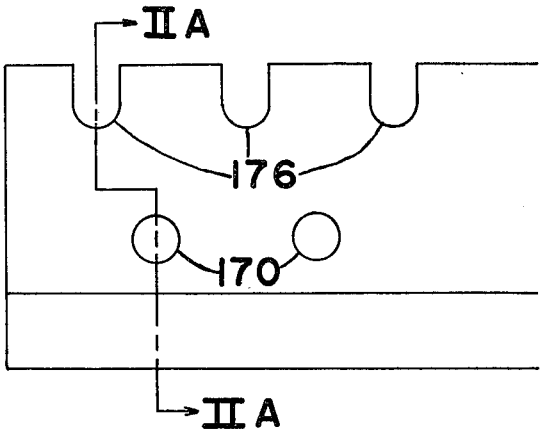
FIG. 2B is a rear elevation view of the baffle of FIG. 2A, the relationship between FIGS. 2A and 2B being shown by line IIA—IIA in FIG. 2B.

Referring now to FIGS. 2A and 2B, an alternate embodiment of the dams 59 depicted in FIG. 1 is illustrated. In this case, a vertical dam 168, shown located on anode 46, has horizontally extending openings or passageways 170 extending through it beneath bath surface 172, 173, on both sides of the dam. These passageways 170 cause lateral flow of the bath through the dam at a level beneath the bath surface, as illustrated by arrow E. This directs molten metal brought upwards in passage 55 to move laterally above anode 46 without breaking the surface of the bath where the metal can be rechlorinated. In this embodiment the passageways 170 are displaced upwards from the level of the top of the anode. This causes some molten metal to accumulate in the form of a pad 174 on the top of the anode. This pad will build up to a certain height as determined by capillary forces and then begin to feed down into bath supply passage 56, as illustrated in FIG. 2A by descending globules.

In addition to passageways 170, the embodiment of FIGS. 2A and 2B may also include passageways 176 adjacent the top of the dam for the purpose of providing additional area for accommodation of the lateral flow of bath, as illustrated by arrow F. The gas phase chlorine moves essentially straight upwards as indicated by arrow G to break the surface 173. Because of the density of the entrained metal, in comparison to that of the bath and the gas phase, the metal tends to travel the lower route provided by passageways 170.

Figure 3B:
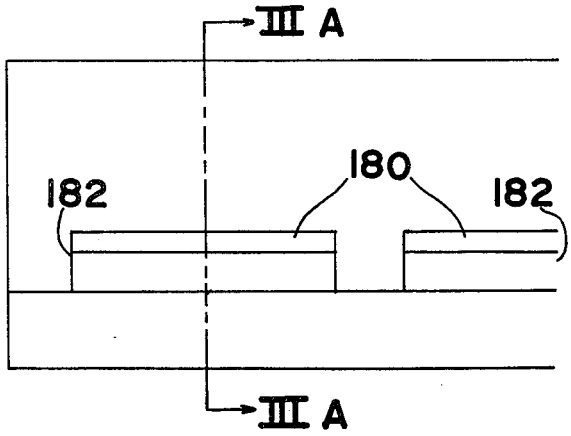
FIG. 3B is a front elevation view of the embodiment of FIG. 3A, the relationship between FIGS. 3A and 3B being shown by line IIIA—IIIA in FIG. 3B.

FIGS. 3A and 3B illustrate a third embodiment of the invention. In this embodiment, a vertical dam 178 is provided with a ledge 180 extending downwardly into a horizontal passageway 182 from the roof of the passageway. Any chlorine that might be caught by the lateral flow of the bath (illustrated by arrow H) into passageway 182 is retained or captured by dam 180. Analogous to the behavior of metal pad 174 on 46, the captured chlorine builds up to a certain thickness and then feeds off in the direction of arrows J and I to proceed to bath surface 173. In addition, FIG. 3A shows small globules of molten metal being swept by the bath along the top of anode 46 thence to descend through passage 56.

Further illustrative of the present invention is the following example:

Example

The cell of FIG. 1 was constructed as a twelve compartment bipolar cell (i.e. an anode, a cathode and eleven bipolar electrodes) and then filled with an average molten salt bath of the following composition in weight percent:

NaCl: 51.0;
LiCl: 40.0;
$AlCl_3$: 6.5;
$MgCl_2$: 2.5.

Electrolysis to produce molten aluminum and chlorine gas was carried out with 31 volts applied across the cell, i.e. applied between anodes 46 and cathodes 50, and an average temperature of 715° C maintained by a coolant circulated through jackets 10 and 14. Under such operating conditions, the chlorine gas and bath flowed rapidly across the electrodes to and upwardly through passage 55. The baffles of the invention were effective in redirecting bath flow over the anodes and beneath the upper level of the bath.

Figure 4:
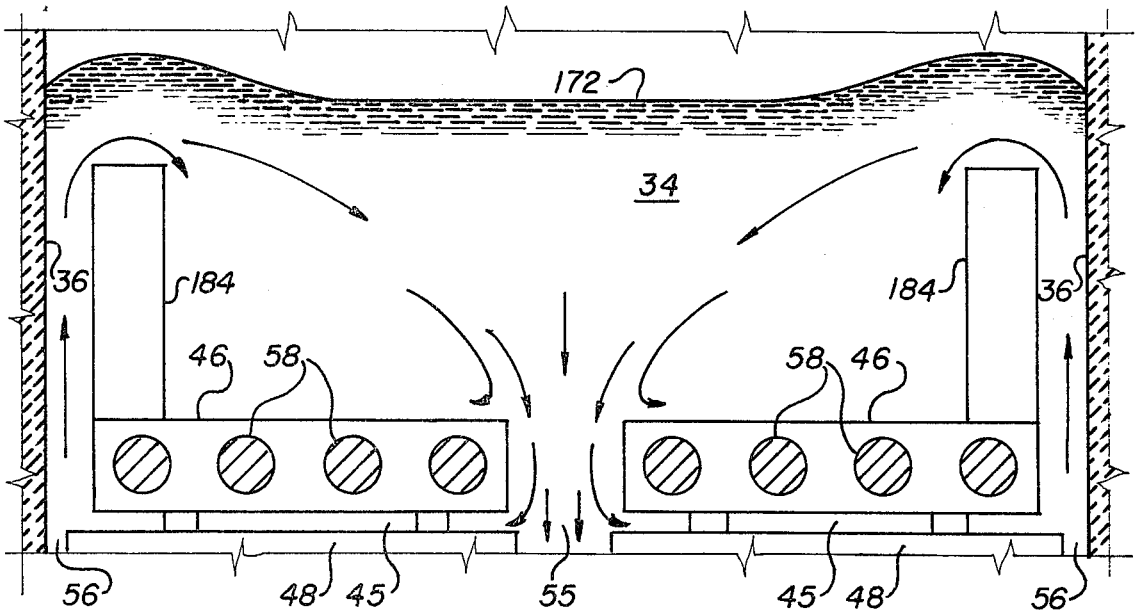
FIG. 4 is a partial schematic view of the cell of FIG. 1 depicting another embodiment of the invention.

In FIG. 4 of the drawings, an embodiment of the invention is shown in which the liquid and gaseous flow pattern of the cell of FIG. 1 is reversed, as indicated by the arrows shown in flow passages 55 and 56 and in the bath reservoir area 34. (In FIGS. 1 and 4, like reference numerals refer to like components.) In FIG. 4 baffle structures 184 are located adjacent the outside edges of anodes 46 and outside flow (upcomer) passages 56, as opposed to the inside location of baffles 59 in the FIG. 1 embodiment. Baffles 184 are solid wall structures mounted vertically on the top of each anode 46, the upper edge of each baffle extending to a location beneath the level 172 of the bath. In addition, the baffles extend into the plane of the drawing, preferably the full length of the anodes.

Again, referring to the arrows in FIG. 4, the gas produced in the smelting process rises through outside passageways 56 to escape through the surface 172 of the bath, the upward flow of the gas effecting an upward flow of electrolyte and metal. The upward surge creates in surface 172 a plume, which is indicated somewhat schematically in FIG. 4. As indicated by the arrows depicted over baffles 184, the electrolyte and metal flow over the top of 184 and toward the center passageway 55. A certain amount of the electrolyte and metal does not proceed directly to passageway 55 after flowing over the top of baffles 184. Rather, it is circulated back toward passages 56 in a vortex-like flow. Baffles 184 are effective to prevent the metal in this recirculating amount from getting into passages 56 again where it stands another chance of being flung up into the chlorine atmosphere above the bath, there to be recombined with chlorine.

As further shown in FIG. 4, the flow pattern is such that the bath and metal tend to move along the upper surface of the anodes towards baffles 184. If baffles 184 were not included or were provided with openings adjacent the upper surface of the anodes, such movement of bath and metal would be greatly enhanced. In addition, the entrained metal would reenter the upcomer passages to be circulated upwardly again toward bath level 172, thereby increasing the possibility of the metal entering the oxidizing atmosphere above 172.

However, in the embodiment of FIG. 4, the baffles are solid structures which do not permit direct access to the upcomer or side passages 56. This, in addition, tends to reduce the component of the velocity flowing along the upper surfaces of the anodes and hence tends to increase the flow component of the bath and metal down into passageway 55. The increase in downward flow velocity, increases the velocity of bath flow through the metal producing spaces 45, thereby increasing the desired sweeping action described earlier. An increased flow through spaces 45 is likewise caused by baffles 59, 168 and 178. This action rapidly moves the metal from the electrode surfaces so the electrode surfaces are free to produce more metal in the electrolysis process.

Generally, the higher the baffles 184 the greater will be the downward flow component of the bath and metal. On the other hand, the baffle must terminate a distance beneath bath level 172 sufficient to allow ease of bath and metal flow beneath 172 as they rise in upcomer passages 56. Thus, the height of the baffles is chosen to insure that both functions are properly performed.

Baffles 184 are thus both effective for preventing recirculating metal from being re-chlorinated by the atmosphere above the level of the bath and for simultaneously increasing the velocity of bath through metal producing spaces 45. Baffles of these types also serve to keep debris, which might fall from the lid area of the cell, from the flow channels of the cell, where such debris might impede the desired flow of materials within the cell.

It will be understood that the above description of the present invention is susceptible to various modifications, changes, and adaptations and the same are intended to be comprehended within the meaning and range of equivalents of the appended claims.

What is claimed is:

1. An electrolytic cell for producing metal in a bath of molten salt, said bath being capable of flowing in the cell to remove molten metal from spaces provided between superposed electrodes of the cell, said cell including a bath of molten salt having an upper level within the cell, at least one vertical stack of superposed electrodes located in the bath, the uppermost electrode of the stack being located beneath the upper level of the bath, the vertical stack being arranged to provide spaces between adjacent electrodes for the production of metal, and passages within the cell that extend vertically between upper and lower regions of the cell, said vertical passages permitting respective upward and downward flow of the bath, and a baffle located adjacent the passage for the upward flow of the bath and extending vertically above the uppermost electrode of the vertical stack, said baffle being effective to increase the flow of the bath and molten metal in the spaces between adjacent superposed electrodes of the vertical stack, and to direct the upward flow of the bath that occurs in the upward flow passage laterally over the uppermost electrode but beneath the upper level of the bath, the lateral direction of the bath beneath its upper level being effective to substantially reduce opportunity for molten metal to break through the upper level of the bath.

2. The cell of claim 1 in which the vertical baffle is a solid wall structure, the upper edge of which is located beneath the upper level of the bath.

3. The cell of claim 1 in which the vertical baffle is provided with a plurality of horizontally extending openings located beneath the upper level of the bath and above the uppermost electrode, whereby the baffle is effective to direct an upward flow of the bath and metal laterally and beneath the upper level of the bath.

4. The cell of claim 1 in which the vertical baffle is provided with at least one horizontally extending opening that permits the bath and metal to flow laterally beneath the upper level of the bath and, a downwardly extending ledge located within said opening, said ledge being effective to collect in said opening any gas that may be present in the lateral flow of the bath.

* * * * *